United States Patent [19]

Pum

[11] Patent Number: 4,977,653

[45] Date of Patent: Dec. 18, 1990

[54] APPARATUS FOR NEEDLING A WEB SUPPORTED BY A GRATE OF BLADES TRANSVERSE TO NEEDING DIRECTION

[75] Inventor: Hannes Pum, Wels, Austria

[73] Assignee: Textilmaschinenfabrik Dr. Ernst Fehrer Aktiengesellschaft, Leonding, Austria

[21] Appl. No.: 472,605

[22] Filed: Jan. 30, 1990

[30] Foreign Application Priority Data

Feb. 15, 1989 [AT] Austria ..... 333/89

[51] Int. Cl.[5] ..... D04H 18/00

[52] U.S. Cl. ..... 28/115; 28/111

[58] Field of Search ..... 28/107, 111, 113, 114, 28/115

[56] References Cited

U.S. PATENT DOCUMENTS 2,004,544 6/1935 Waters et al. ..... 28/113 X 4,277,531 7/1981 Picone ..... 28/115 X

*Primary Examiner*—Werner H. Schroeder

*Assistant Examiner*—Bradley Kurtz DeSandro

*Attorney, Agent, or Firm*—Kurt Kelman

[57] ABSTRACT

In order to increase the latitude regarding the distribution of needles in a needle board in a direction which is transverse to the direction of travel of a web which is to be needled in an apparatus for needling the web while it is supported by a deck provided with a grate of parallel blades, it is proposed to arrange the blades of the grate so that they extend transversely to the direction of travel of the web.

4 Claims, 3 Drawing Sheets

APPARATUS FOR NEEDLING A WEB SUPPORTED BY A GRATE OF BLADES TRANSVERSE TO NEEDING DIRECTION

BACKGROUND OF THE INVENTION

1. Field of the Invention

This invention relates to an apparatus for needling a web, comprising a deck, which is provided with a grate of parallel blades for supporting the web, at least one driven needle board for needling the web as it is conveyed over the deck, and a stripper plate, which has needle-receiving through holes and is disposed between the needle board and the grate of parallel blades.

2. Description of the Prior Art

When it is desired to needle a web, the needles of the needle boards are moved at a predetermined stroke frequency through the through holes of the stripper plate into the web, which is conveyed over the table. As the needles are pulled out, the stripper plate prevents a lifting of the web from the deck. The web support which is constituted by the deck must have suitable openings for receiving the points of the needles which have penetrated the web. For that purpose it is known to provide as a support for the web a perforated plate provided with holes in a spacing which is equal to the needle spacing. If loops for forming surface patterns are pulled adjacent to that surface of the web which faces the deck, the provision of a perforate plate as a web support will involve the risk that such loops may protrude into the holes for receiving the needle points and bulges may be formed in the web and such loops or bulges may considerably increase the resistance to the withdrawal of the web. For this reason, the perforate plates have been replaced by grates of parallel blades extending in the direction of travel of the web. But such grates of parallel blades have the disadvantage that the required strength of the blades will impose a restriction regarding the needle density in the direction which is transverse to the direction of travel of the web, particularly because the needles can be arranged only in longitudinal rows. On the other hand, the needle density and the distribution of the needles in a direction which is transverse to the direction of travel of the web will have an important influence on the result of the needling operation because the density of the points of penetration in a direction which is transverse to the direction of travel cannot be changed by a control of the speed of travel of the web whereas such control can be adopted to change the density of the points of penetration in the direction of travel. For that reason the spacing of the blades must be selected in close adaptation to the spacing of the rows of needles and an alteration of the needling apparatus to a different distribution of the needles will require a replacement not only of the needle board and stripper but also of the web-supporting grate of parallel bars.

SUMMARY OF THE INVENTION

For this reason it is an object of the invention to avoid said disadvantages and so to improve with simple means an apparatus which is of the kind described first hereinbefore and serves to needle a web that the grate of parallel blades does not impose a restriction regarding the distribution of the needles in a direction which is transverse to the direction of travel of the web and that such grate can be used with needles having various spacings.

That object is accomplished in accordance with the invention in that the blades of the grate of parallel blades extend transversely to the direction of travel of the web.

By that simple measure it is ensured that the means for supporting the web will not impose any restriction regarding the distribution of the needles in the direction which is transverse to the direction of travel of the web because adjacent blades define between them a continuous passage for all adjacent needles. It is surprising that the blades extending transversely to the direction of travel of the web do not substantially increase the resistance to the withdrawal of the web. As a result, the otherwise existing restrictions regarding the density of the points of penetration are eliminated and grates of parallel blades may be used also for a needling of webs which have a continuously uniform, unpatterned surface. Whereas the blades extending transversely to the direction of travel of the web have an influence on the distribution of the needles in the direction of travel of the web, any resulting irregularity of the needle density in the direction of travel of the web can readily be compensated in that the travel of the web is properly controlled. If the spacing of the needles in the direction of travel of the web is not less than a certain minimum adjacent to each blade which extends transversely to that direction, it will be possible to change the needle distributions as desired without a need for a replacement of the grate of parallel blades together with the replacement of the needle board.

When juxtaposed convolutions of narrow webs are needled to wider carrier webs, e.g., in the manufacture of paper machine felts, the feeder for feeding the narrow web will be moved across the width of the carrier web and the needling apparatus, inclusive of the deck, will be moved in unison with the feeder. The working width of said needling apparatus will correspond to the width of the web that is to be needled. Different from known grates of parallel bars, grates in which the blades extend transversely to the direction of travel of the web permit of a transverse movement of the needle board relative to the deck so that in such case the length of the parallel blades of the grate may exceed the working width of the needle board and the needle board and the stripper plate may constitute a movable unit, which is reciprocable over the length of the blades. In that case it is no longer necessary to reciprocate the deck over the width of the carrier web in synchronism with the needle board. As a result, the deck provided with the stationary grate of parallel bars constitutes a greatly simplified structure.

The use of blades which are much longer than those of a grate of parallel blades which extend in the direction of travel of the web will require the grate of parallel blades to have an adequate stiffness. Because the needle density can be changed in relatively large ranges, the blades may have a relatively large width so that the blades may be overloaded in some cases unless special measures are adopted. In order to increase the load-carrying capacity of the grate of parallel blades, the blades of said grate may be constituted by discrete sections, each of which constitutes a length portion of at least two juxtaposed blades and which are supported on a bedplate of the deck. The combination of at least two blades in a section which is secured to a sufficiently stiff bedplate of the deck will ensure that the grate of parallel blades has a high load-carrying capacity and the provision of long blades composed of discrete length sections will result in a modular system which permits a manufacture of different grates of parallel blades from a few basic elements.

The stiffness of the deck provided with the grate of parallel blades may be further increased in that the sections of adjacent rows of sections which are mounted on the bedplate are longitudinally staggered.

DETAILED DESCRIPTION OF THE PREFERRED EMBODIMENT

Figure 1:
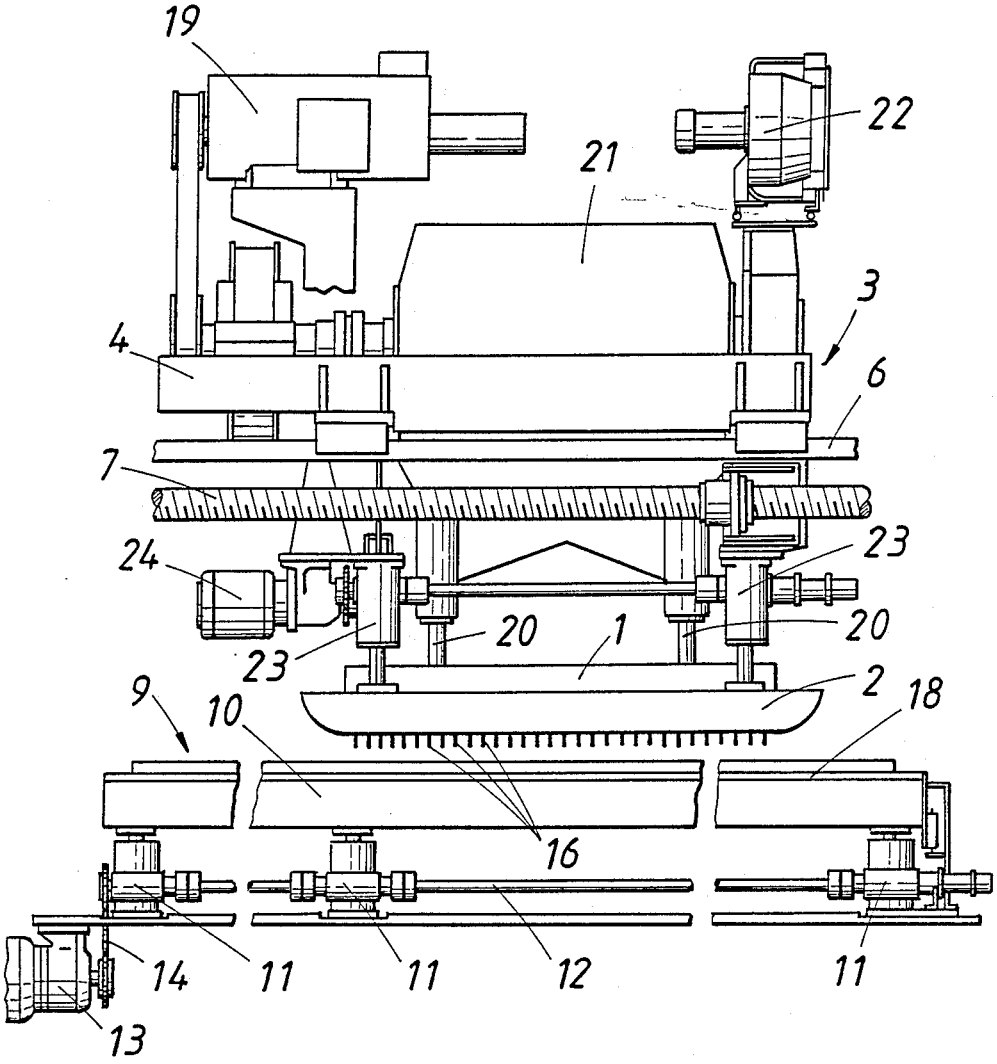
FIG. 1 is a diagrammatic elevation showing an apparatus in accordance with the invention for needling a web, viewed in the direction of travel of the web.
Figure 2:
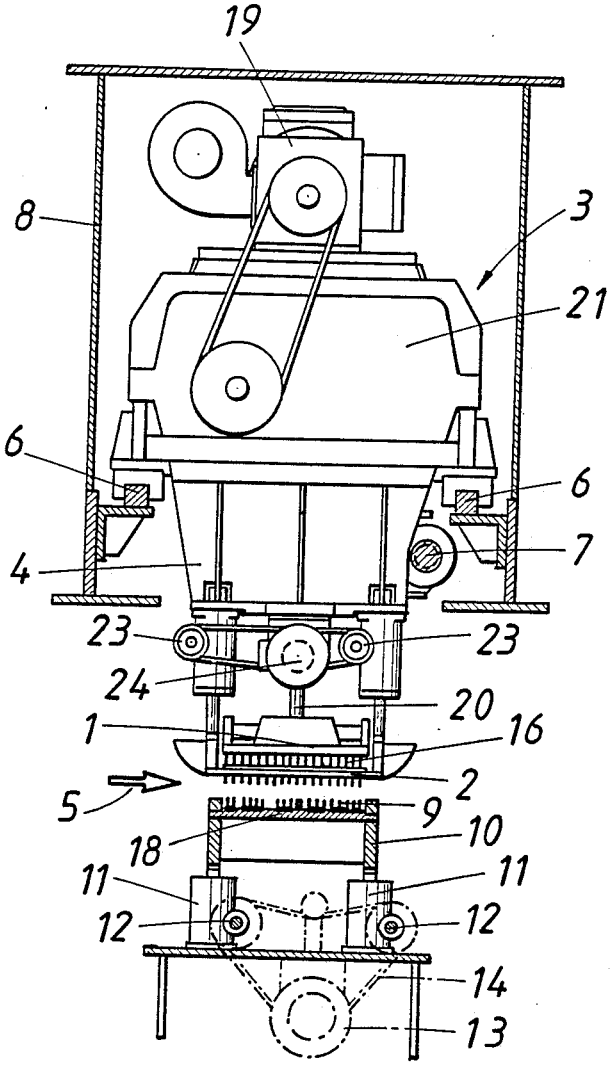
FIG. 2 is a simplified transverse sectional view showing that apparatus.

An illustrative embodiment of the invention is shown on the drawing.

In the embodiment illustrated by way of example the apparatus serves to needle a narrow web to an endless carrier web, which is trained around reversing pulleys and is to be provided with a single- or multi-layer covering consisting of juxtaposed convolutions of the narrow web. This will be necessary if a non-woven web is to be needled to a woven base fabric in the manufacture of paper machine felts. The unit 3 comprises a needle board 1 and a stripping plate 2 and constitutes a carriage 4, which is movable on rails 6 transversely to the direction of travel 5 of the web and is adapted to be driven by a screw 7, which is rotatably mounted in a box girder 8, which accommodates the carriage 4.

The support for the web is constituted by a grate 9 of parallel blades. That grate is mounted on a deck 10, which can be adjusted in height for changing the depth of penetration. That adjustment can be effected by means of worm gear trains 11, which are driven via two parallel shafts 12 from a common motor 13 by means of a chain drive 14. The illustrated grate of parallel bars differs from the conventional grates in that its blades 15 extend transversely to the direction of travel 5 of the web rather than in said direction so that the needles 16 of the needle board 1 can freely move in the spaces between adjacent blades 15 transversely to the direction of travel 5 of the web during a movement of the carriage 4. For this reason the grate 9 of parallel bars need not be moved in unison with the carriage 4 transversely to the direction of travel 5 of the web. As a result, the grate 9 of parallel blades may be secured to the deck 10, which is adjustable only in height, and said grate 9 may extend throughout the range of travel of the carriage 4 and this will not interfere with the needling of the web which has been applied to the carrier web at a predetermined lead angle.

As each blade 15 has a length which is a multiple of the working width of the needle board 1, special measures must be adopted to ensure that the grate 9 of parallel blades has an adequate stiffness. To take up the loads applied, the blades 15 are composed of discrete sections 17*a* and 17*b*, each of which constitutes two or three blades 15 and which have a predetermined length. As a result, the grate 9 of parallel blades is a modular system composed of the sections 17*a* and 17*b*, which are arranged in rows. Each of said sections 17*a* and 17*b* has a higher stiffness in itself and they are additionally supported on a stiff bedplate 18 of the deck so that the required load-carrying capacity of the grate 9 of parallel blades can readily be ensured.

The movable unit 3 is designed as usual and comprises drive means 19 for the push rods 20, which carry the needle board and are driven by a crank drive or eccentric drive 21. The stroke of that drive 21 can be adjusted by an adjusting device 22. For an adjustment of the level of the stripper plate 2 to the thickness of the web, the stripper plate 2 is mounted to be adjustable in height by means which are similar to the means for adjusting the deck 10 and comprise work gear trains 23, which are driven by a common motor 24.

Figure 3:
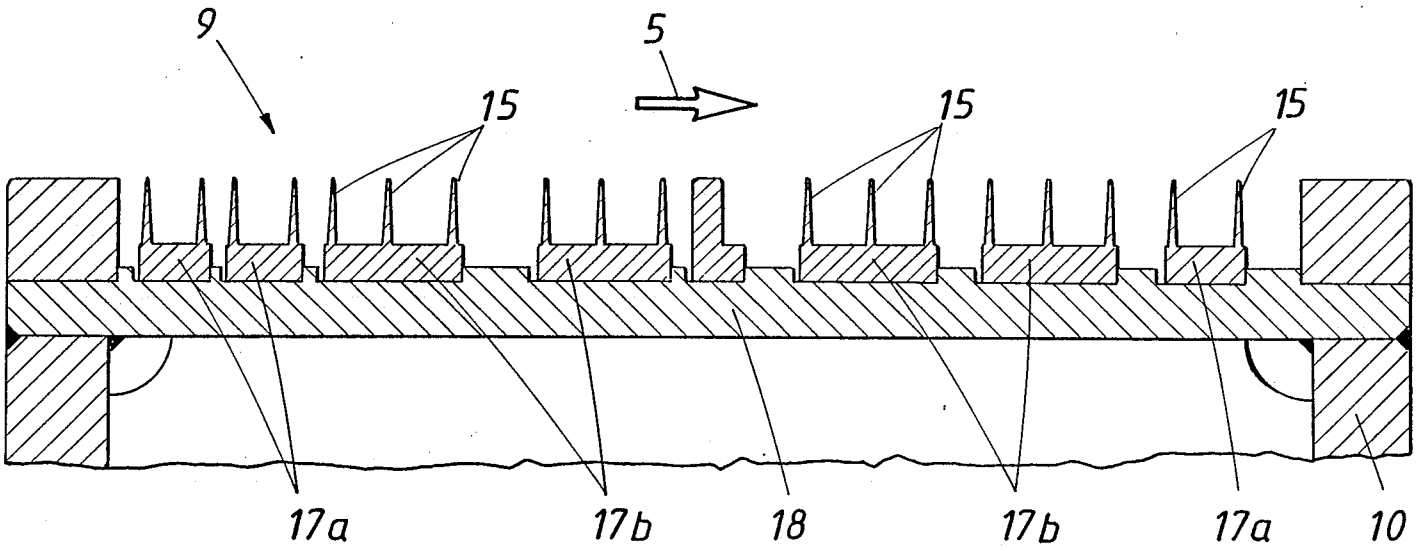
FIG. 3 is a transverse sectional view showing on a larger scale the grate of parallel bars viewed on a plane extending in the direction of travel of the web.

As is directly apparent from FIG. 3, the spacing of the needles is determined by the sections 17*a* and 17*b* only in the direction of travel 5 of the web rather than transversely thereto. The density of the points of penetration in a direction which is transverse to the direction of travel 5 of the web depends only on the needle density but is independent of the speed of travel of the web and is restricted only by the requirements regarding the mounting of the needles in the needle board. This means also that different needle distributions in a direction which is transverse to the direction of travel may be adopted in conjunction with a given grate 9 of parallel blades, provided that the needle spacing in the direction of travel 5 is selected in consideration of the blade spacing.

In a needling apparatus which is transversely movable over the width of a web to be needled or of a carrier web, special advantages will be afforded by the use of a grate of parallel bars extending in the direction of such transverse movement. But such grate of parallel bars can be used to advantage also with a needling apparatus which is not traversible because an alteration of the needling apparatus for a different needle spacing will greatly be simplified in such case without a risk of a structuring of the surface of the web whereas such structuring will necessarily be effected if the blades extend in the direction of travel. In the present case the needle distribution in a direction which is transverse to the direction of travel of the web can freely be selected.

I claim:

1. In an apparatus for needling a web comprising a deck provided with a grate of parallel blades for supporting a web which is to be needled, at least one needle board, which comprises a multiplicity of spaced apart needles and is operable to needle said web by means of said needles as said web is supported on said grate and moved in a predetermined direction of travel on said grate, and a stripper plate, which is disposed between said needle board and said grate and formed with through holes for receiving respective ones of said needles, the improvement residing in that said blades extend transversely to said direction of travel.

2. The improvement set forth in claim 1, wherein said needle board has a predetermined working width along said blades, said blades have a length which exceeds said working width, said needle board and said stripper plate are movable in unison along said blades over the length of said blades.

3. The improvement set forth in claim 1, wherein said deck comprises a bedplate, said grate of parallel blades is composed of a plurality of sections which are supported on said bedplate and arranged in a plurality of rows extending transversely to said direction of travel, and said sections of each of said rows comprise respective length sections of at least two adjacent ones of said blades.

4. The improvement set forth in claim 1, wherein said sections of adjacent ones of said rows are staggered in their longitudinal direction.

* * * * *